US005174203A

United States Patent [19]

Maeda

[11] Patent Number: 5,174,203

[45] Date of Patent: Dec. 29, 1992

[54] MULTI-COLOR SILK SCREEN PRINTING METHOD

[76] Inventor: Hikaru Maeda, 102-1, Tomihara, Okayama-shi, Japan

[21] Appl. No.: 695,541

[22] Filed: May 3, 1991

[51] Int. Cl.[5] ..... B41M 1/12

[52] U.S. Cl. ..... 101/129; 101/114

[58] Field of Search ..... 101/114, 115, 128.21, 101/128.4, 129

[56] References Cited

U.S. PATENT DOCUMENTS

| | | | |
|---|---|---|---|
| 1,780,260 | 11/1930 | Capwell | 101/115 |
| 2,278,771 | 4/1942 | Csaszar | 101/115 |
| 4,869,165 | 9/1989 | Louiche | 101/115 |

FOREIGN PATENT DOCUMENTS

| | | | |
|---|---|---|---|
| 195696 | 12/1982 | Japan | 101/129 |
| 199882 | 11/1984 | Japan | 101/129 |
| 58889 | 4/1985 | Japan | 101/129 |
| 120098 | 6/1985 | Japan | 101/128.21 |

*Primary Examiner*—Edgar S. Burr
*Assistant Examiner*—Ren Yan
*Attorney, Agent, or Firm*—Koda and Androlia

[57] ABSTRACT

A sheet of multi-layer seal film is cut along desired boundary lines for coloring, and is adhered on a silk screen. Printing is effected by repeating a series of procedure as follows. When seal film sections which have been cut into patterns to be printed in a common color are removed from the screen, ink permeable holes are formed to carry out printing, and the ink permeable holes after printing are closed with resin. A section with at least one gradational pattern is printed by forming a large number of screen-mesh apertures through a covering film of the resin. For additional printing, a piece of already-cut seal film is adhered on the screen prior to applying the resin liquid to the screen.

3 Claims, 5 Drawing Sheets

MULTI-COLOR SILK SCREEN PRINTING METHOD

BACKGROUND OF THE INVENTION

1. Industrial Field of the Invention

The present invention relates to an improvement of a cutting method in the silk screen printing industry. The invention concerns a novel printing method capable of conducting accurate multi-color printing by a single screen, as well as gradational pattern printing, and also, different patterns can be additionally printed over the surface of a printing article which has been already printed, to thereby enable more complicated matters to be printed out.

2. Description of the Prior Art

Silk screen printing methods are classified into a direct method in which a pattern mask is used, an exposure method in which a photosensitive resin film is used, and a cutting method which the present invention intends to improve.

Conventionally, the cutting method has not been commonly employed because the processed film cannot print a stack of many sheets. Further, printing articles are limited to paper and cloth, and regeneration of a screen cannot be carried out.

In order to solve one of the problems of the cutting method that many sheets of paper cannot be printed, there is suggested, manufacturing method of a screen for printing and textile printing which uses a film sheet having such a structure that an adhesive layer is interposed between a film and a base paper. In this conventional example, however, the film is adhered on the screen and continues to be used as it is until the end of printing operation, so that the film is restricted to polyvinyl alcohol or the like which does not dissolve into printing ink. Further, the adhered film becomes loose and separated from the screen after it has been used a plurality of times, and this is a problem in common with a conventional method of varnish paper which is adhered on a screen by heating.

Such a film of polyvinyl alcohol or the like which is cut and adhered on the screen accordingly forms film sections through which printing ink should not be permeated. This relates to a fact that it has conventionally been almost impossible to define or express thin lines and outlines in silk screen printing of the cutting method. That is to say, when the cut film sections are to form non-permeable film sections as they are, it is almost impossible to cut the film along thin and curved lines having a width of several tenths millimeters such as outlines or hair even if it is necessary. Besides, even if cutting can be managed, the cut film sections adhered on the screen have a problem in adhesion strength that the non-permeable film sections cannot maintain its printing faculty through a great many times of printing. This conventional method still involves problems to be solved in respect of the quality of finished printing, the possible number of times of printing, and the like.

Recently, it has been required to print more complicated and finer matters even in silk screen printing of the cutting method.

For instance, it has been expected to enable silk screen printing of the cutting method to express gradational patterns of tone difference and blurring, and to print additional patterns overlapping an already printed color surface, which can otherwise be easily managed in paintings. In silk screen printing of the cutting method, the gradational patterns in the former case have been almost impossible to express, and the dual printing in the latter case has not been easily conducted.

SUMMARY OF THE INVENTION

The present invention intends to solve the above-described problems of silk screen printing of the conventional cutting method so as to enable more complicated and finer matters to be printed out.

This object of the invention has been attained by the inventors by developing a special seal film which is suitable for silk screen printing of a cutting method and discovering that when the film is used with resin, multi-color printing can be effected by a single screen, and that gradational patterns and additional patterns can be printed over a color surface already printed.

In the present invention, there is used a sheet of multi-layer seal film laminated in such a manner that a film $f_2$ which is to be cut into pattern seal film sections is adhered, by a weak adhesive layer, on a base film $f_1$ for supporting the film $f_2$ at the time of cutting operation, and that separation paper $f_3$ is adhered on the film $f_2$ by a strong adhesive layer. This seal film is cut along desired boundary lines for coloring, and after separating and removing the separation paper $f_3$ from the seal film, the seal film is adhered on a silk screen by the strong adhesive layer. Next, the base film $f_1$ and seal film sections which have been cut into patterns to be printed in a common color are removed from the seal film, so as to form ink permeable holes, and succeedingly printing is conducted (as shown in Step 1 in the PRINTING EXAMPLE 1). After printing, the ink permeable holes are closed by resin which is not intimate to oil when printing ink is oil ink and by resin which is not intimate to water when printing ink is water ink. Then, multi-color printing is effected by repeating a plurality of times a series of procedure of removing pattern seal film sections of a different color from the seal film so as to similarly conduct printing by using printing ink of the different color, and closing ink permeable holes after printing (as shown in Step 2 and Step 3 in the PRINTING EXAMPLE 1).

When at least one gradational printing pattern is required, a large number of screen-mesh apertures in accordance with the gradational pattern are formed in a covering film of the resin for closing the ink permeable hole before the resin is solidified, and printing is conducted with the section of the gradational pattern of the covering film having the apertures after the covering film of the resin has been solidified, thereby enabling multi-color silk screen printing in which the gradational pattern can be added if necessary (as shown in Step 4 in the PRINTING EXAMPLE 1). It is preferable that these apertures are formed in the covering film of the resin when the covering film of the resin is partially removed by contacting a foamed material or a sponge with the resin film.

Further, a piece of seal film which has been cut along desired boundary lines for coloring is adhered on the silk screen prior to closing, with resin, the ink permeable holes used for printing, thus enabling multi-color silk screen printing in which other patterns can be printed over an already printed color surface.

The seal film in this case has such a multilayer structure that the film $f_2$ is adhered on the film $f_1$ by the weak adhesive layer, and that the separation paper $f_3$ is further adhered on the film $f_2$ by the strong adhesive layer. The separation paper $f_3$ serves to keep the strong adhesive layer free from the dust and the like. The word "strong adhesive layer" in this case means an adhesive layer whose adhesion strength is relatively larger than that of the weak adhesive layer interposed between the films $f_1$ and $f_2$. In place of the weak adhesive layer, the film $f_2$ may be adhered on the film $f_1$ by separable adhesion means such as electrostatic adhesion means. The film $f_1$ is a base film for supporting the film $f_2$ at the time of cutting operation, and this base film has such a thickness that it cannot be readily cut by a cutter. The film $f_2$ is to be divided into pattern film sections and adhered on the silk screen so as to carry out printing operation effectively, which will be described later.

For the resin liquid, resin which is not intimate to oil such as polyvinyl alcohol is used when printing ink is oil ink, and resin for general use which is not intimate to water is used when printing ink is water ink. In other words, when printing is conducted with oil ink, water soluble resin such as polyvinyl alcohol (PVA) is used for forming a film on the screen, and the pattern seal film sections are adhered on the screen by adhesive material which can be dissolved in an organic solvent of the same dissolution polarity as the printing ink (for example, acrylic rubber adhesive which can be dissolved in thinner). With this arrangement, each pattern seal film section can be easily separated from the screen when the back surface of the screen in an area corresponding to the adhesion surface of the pattern seal film section is wiped by a rag which has absorbed the organic solvent. Besides, during printing operation with oil ink, the films are stably maintained on the screen so as to enable printing of a great many sheets of paper (several thousand sheets). After printing operation has been completed, regeneration of the screen can be effected simply by applying water to the films on the screen and dissolving them. Contrary to this example, when printing is conducted with water soluble ink, resin which is not soluble in water is used for forming films on the screen, and the pattern seal film sections are adhered on the screen by water soluble adhesive material of the same dissolution polarity as the printing ink, in order to produce the same effect as described above.

The function of the multi-color silk screen printing method according to the present invention will be described next. Seal film sections which have been cut into patterns to be printed in a common color are removed from the screen so as to form ink permeable holes, and succeedingly printing is conducted. After printing, the ink permeable holes are closed by resin. Then, by repeating a plurality of times a series of procedure of removing pattern seal film sections of a different color from the screen, similarly conducting printing with the different color, and closing ink permeable holes used for printing, multi-color printing can be performed not by a plurality of printing screens but by the single screen.

When utilizing film formation of resin, a large number of apertures can be easily formed before the resin is solidified. Especially when using a foamed material, the resin is removed from the screen by the fine contact surface of the foamed material, and a great many apertures can be effectively formed by a single touch of the foamed material. Therefore, if the foamed material is brought into contact with the screen a plurality of times while manually controlling each touch, ink permeable holes corresponding to gradational patterns can be formed. After the resin has been solidified, the gradational patterns can be printed with this screen when ink permeates through these apertures in large number toward a printing surface.

When ink permeable holes are to be closed by resin after printing, a piece of cut seal film is adhered on the screen prior to applying the resin liquid to the screen. Then, seal film sections which have been cut into patterns to be printed in a common color are removed from the seal film so as to form ink permeable holes, and succeedingly printing is conducted. After printing, the ink permeable holes are closed by the resin. By repeating a plurality of times a series of procedure of removing pattern seal film sections of a different color, similarly conducting printing with the different color, and closing ink permeable holes after printing, printing can be effected with respect to a desired area so as to add other patterns to a color surface already printed. Even if a requisite pattern or the like cannot be found in the cut seal film at the initial stage, the requisite pattern or the like can be additionally printed later.

DETAILED DESCRIPTION OF THE PREFERRED EMBODIMENT

One embodiment of the present invention will be described in detail hereinafter with reference to the attached drawings.

Figure 7:
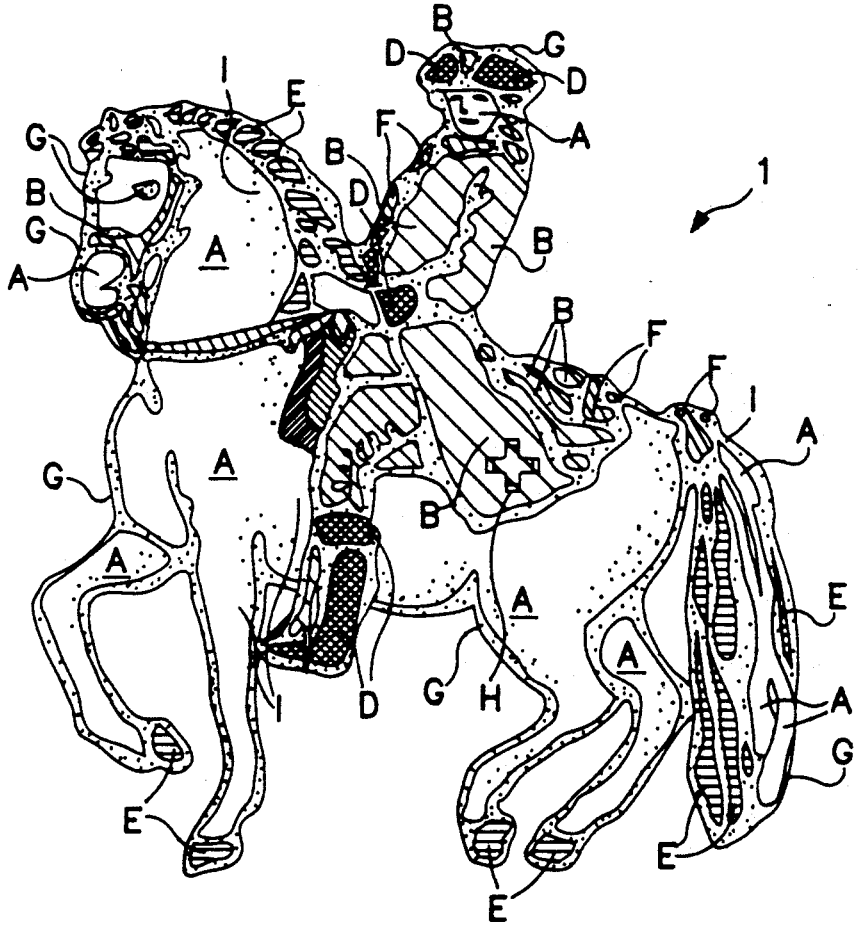
FIG. 7 is a front view of the original picture.

FIG. 7 shows one example of an original picture which can be printed according to a printing method of the present invention. The original picture 1 consists of sections of nine different colors which are designated by reference symbols A to I.

Figure 2:
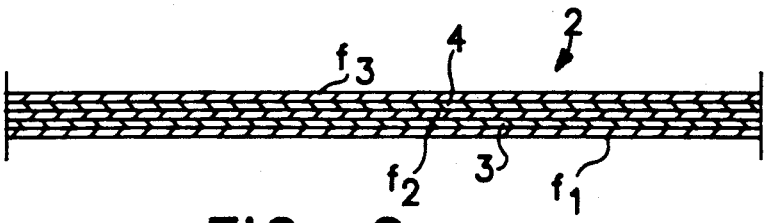
FIG. 2 is an enlarged cross-sectional view of a seal film.

In the printing method of the invention, a seal film 2, as illustrated in an enlarged cross-sectional view of FIG. 2, is laid on the above-mentioned original picture so as to carry out cutting operation of the seal film at the initial stage. The seal film 2 is laminated having such a structure that a film $f_2$ is adhered on a film $f_1$ by a weak adhesive layer 3, and that separation paper $f_3$ is further adhered on the film $f_2$ by a strong adhesive layer 4. The separation paper $f_3$ serves to keep the strong adhesive layer 4 free from the dust and the like. The word "strong adhesive layer" in this case means an adhesive layer whose adhesion strength is relatively larger than that of the weak adhesive layer interposed between the films $f_1$ and $f_2$. The film $f_1$ is a base film, and the film $f_2$ is to be divided into a number of sections which define exposed patterns for carrying out printing operation.

Figure 1:
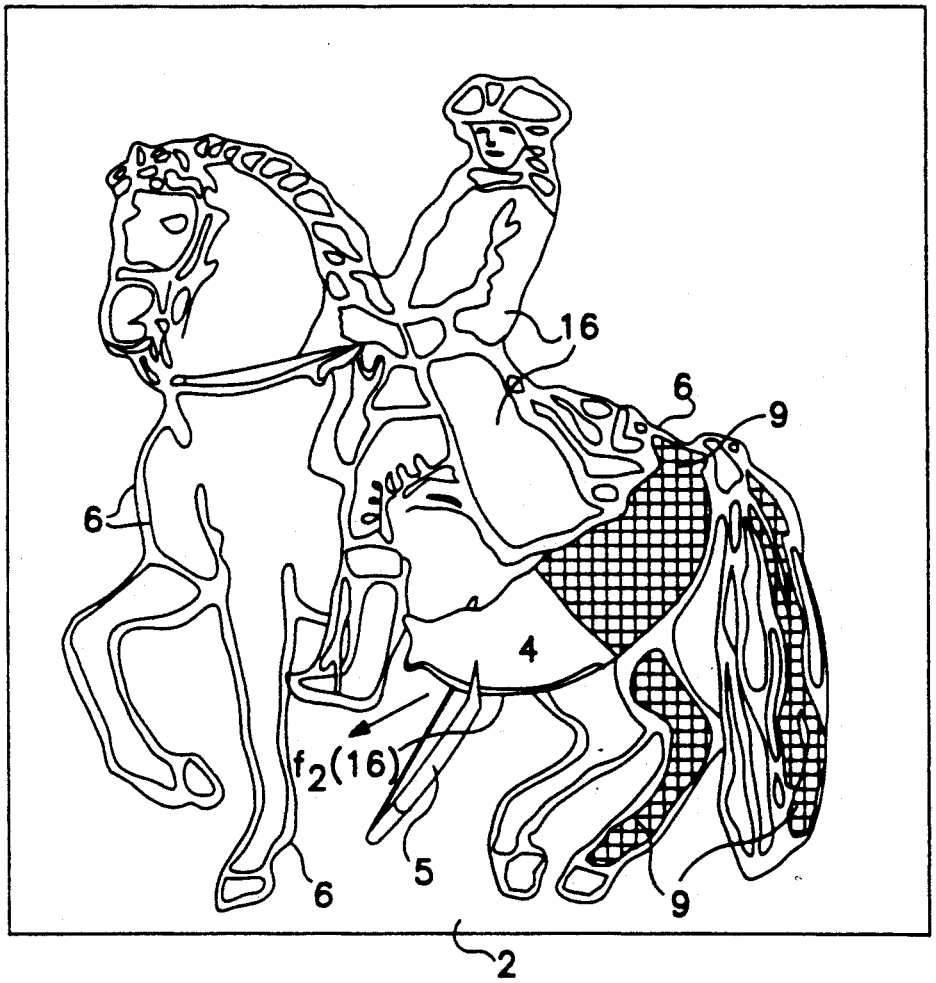
FIG. 1 is a front view of a seal film which has been cut in accordance with an original picture, showing a condition where a pattern seal film section is being removed.

Cutting operation of the seal film 2 of such a five-layer structure is performed in accordance with the original picture 1, as shown in FIG. 1, by applying a cutter to it along boundary lines between the color sections. Cutting lines 6 are not broken but continuous around the outlines of sections of the colors A to G (sections H, I will be explained below) so that the sections can be removed out of the seal film 2 later.

After the seal film 2 has been cut in this manner, the separation paper $f_3$ on the upper surface is removed from the film, and then, the film is adhered on a silk screen with the strong adhesive layer 4 thus exposed. Adhesion can be easily effected by simply pressing the film onto the screen, which is unlike a conventional varnish paper method where heating/pressing is required. If cutting difficulty does not matter, the seal film is not restricted to the above-described five-layer film, and a seal film merely consisting of the film $f_2$ with separation paper for protecting adhesive being adhered on the film $f_2$ can be used.

Figure 3:
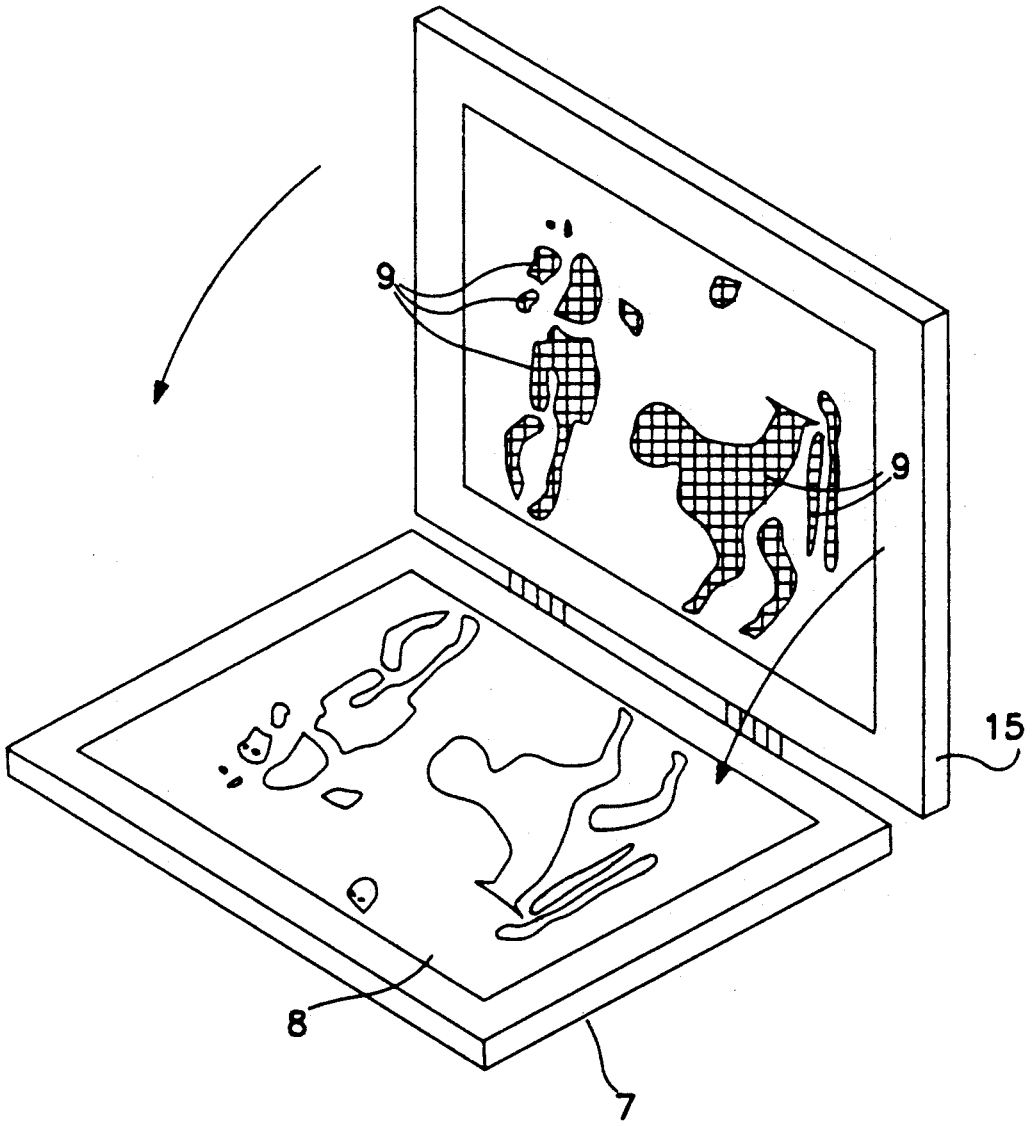
FIG. 3 is a perspective view of a printing board connected with hinges to a frame of a silk screen, showing a condition where one step of operation of the present invention is conducted.

After adhering the cut seal film on the screen and separating the film $f_1$ from the seal film, only the film $f_2$ remains on the screen. At this stage, a frame 15 of the screen is connected with hinges to a printing board 7 (see FIG. 3). A sheet of paper 8 or a sheet of various other things such as cloth, plastics, glass, steel and wood can be placed on the printing board 7.

When completing the preparations described above, printing operation can be started. First, as shown in FIG. 1, pattern seal film sections 16 of the color A are separated and removed from the screen by an appropriate separation tool 5 so as to form ink permeable holes 9. Printing is conducted by applying a squeezing ink supplier, which has absorbed printing ink or paint known in conventional methods, to the surface of the silk screen in this state. A great many sheets of paper can be printed by replacing the sheet of paper 8 on the printing board with a new one. After printing of the sections of the single color A has been finished, the silk screen is held up to be detached from the printing board 7, and then, as shown in the left side of FIG. 4, the ink permeable holes 9 are closed by resin liquid 10. Since the printing ink has a character like oil, polyvinyl alcohol which is not intimate to ink oil is used for the resin liquid 10. Non-permeable films 11 are formed by the applied resin liquid of polyvinyl alcohol when the resin liquid is solidified integrally with the silk screen. Next, in the same manner as described above, pattern seal film sections 16 of the color B are separated and removed from the screen so as to form ink permeable holes 9. Printing is conducted by applying printing ink of the color B to the surface of the silk screen in this state. After completion of the printing operation of the color B, non-permeable films are formed of the resin liquid. Printing of the colors A to G can be effected by the single screen when repeating the same procedure a plurality of times. The colors A to G in this case are different in hue and tone, so that different kinds of printing ink corresponding to the respective colors are selectively used.

Additional color overlapping printing of sections of gradational patterns I which cannot be managed according to the printing procedure described so far and additional color overlapping printing of a section of a cross-shaped pattern H which has not been cut at the first stage of cutting operation (see FIG. 1) will now be explained.

First, the printing of the sections of the gradational patterns I will be described.

Figure 4:
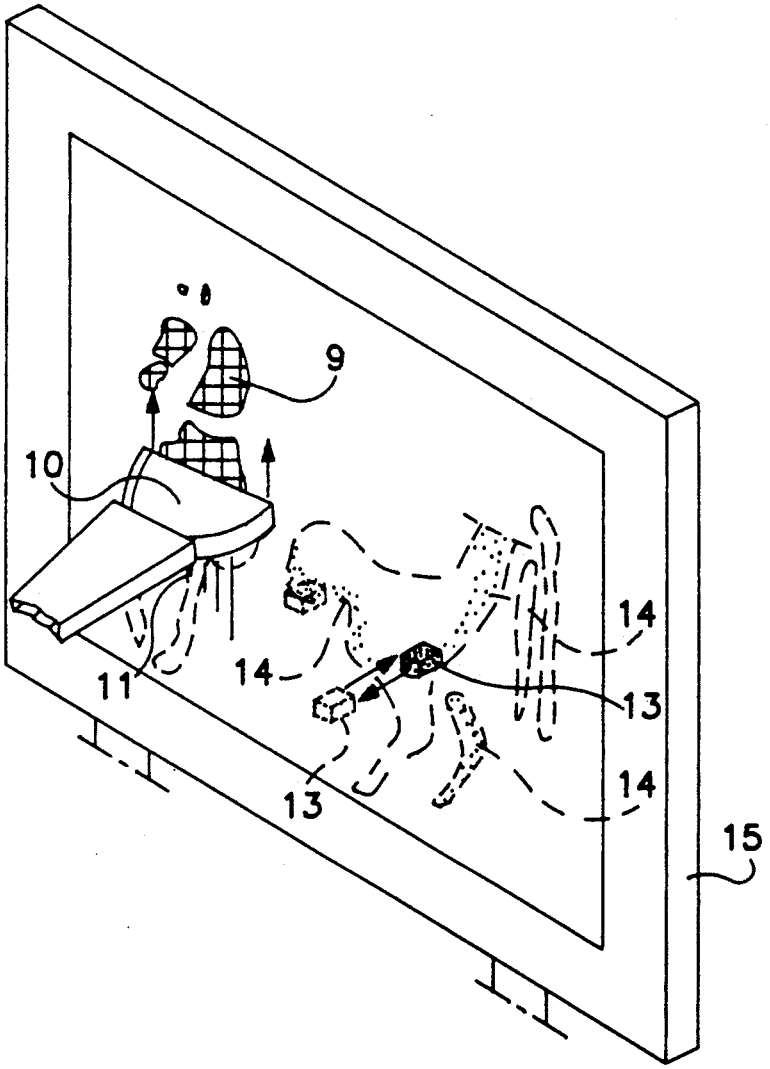
FIG. 4 is a perspective view of the silk screen, showing a condition where ink permeable holes in the screen are being closed by resin liquid whereas a great many apertures are being formed in a region for a gradational pattern.

In the multi-color silk screen printing method described above, when ink permeable holes in the sections where the gradational patterns I are required are closed by the resin liquid after printing of a color, a large number of screen-mesh apertures in accordance with the gradational patterns I are formed through films of the resin for closing the ink permeable holes before the resin is solidified, as shown in the right side of FIG. 4. In order to form a large number of apertures through the resin films, it is preferable that a soft material or a sponge of foamed resin 13 is brought into contact with the resin films before the resin is solidified. The resin films are partially removed, and thus, the apertures 14 in large number are formed. The soft material is successively contacted with the resin films in the sections where the gradational patterns I are required, with contacting operation and pressure being manually controlled according to a degree of gradation in each spot, and consequently, the apertures 14 in large number are formed to an appropriate extent of concentration. After the resin films are solidified, printing of the sections with the apertures 14 in large number is conducted by using printing ink of a color different from the color of the background.

Figure 5:
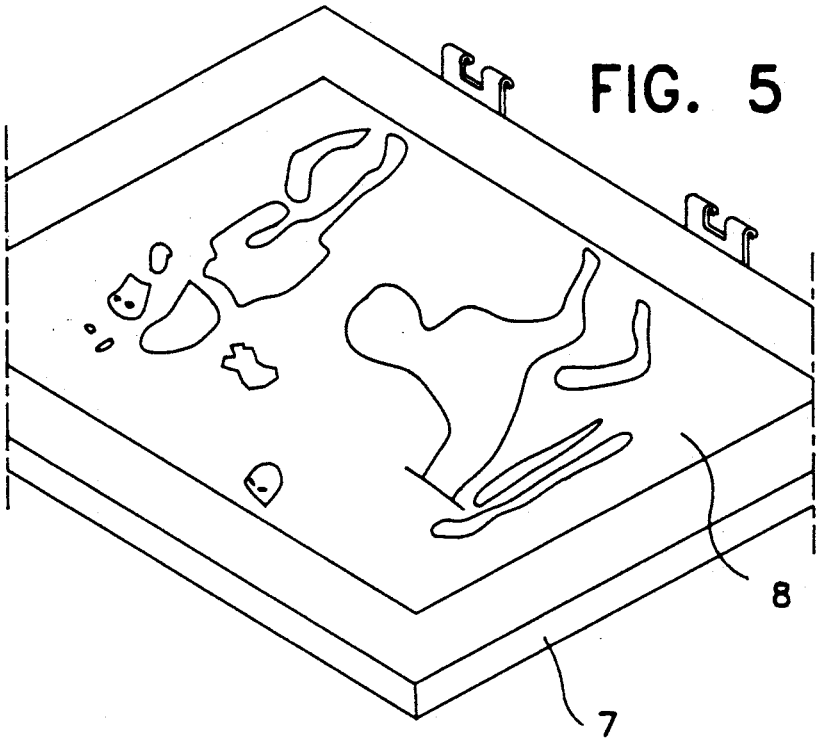
FIG. 5 is a perspective view of a printed article.
Figure 6A:
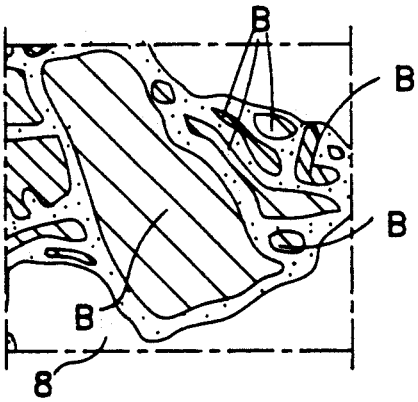
FIGS. 6*a*–6*d* are enlarged views of an essential section of the screen, showing conditions where additional color printing of the invention is performed.
Figure 6B:
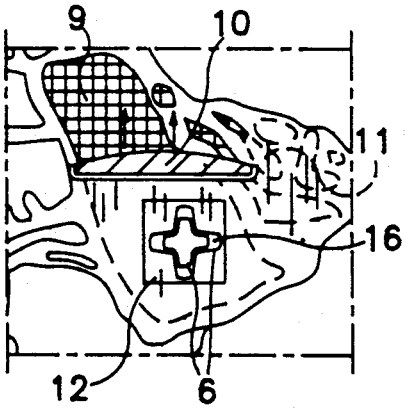
Figure 6C:
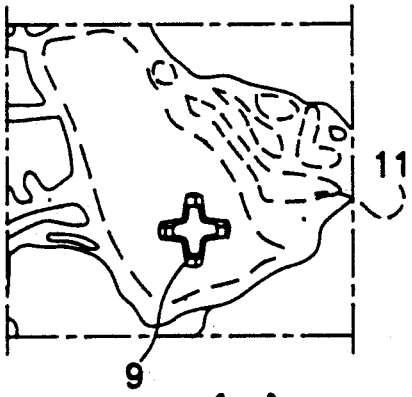
Figure 6D:
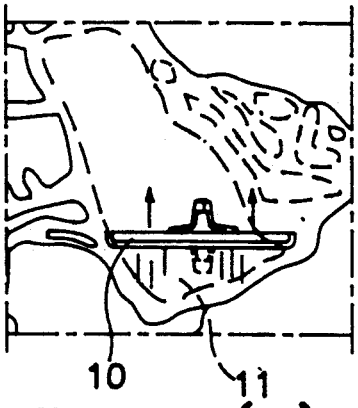

One example of printing is shown in FIG. 5. This example is obtained when printing of the sections of the gradational patterns is performed after the operations described referring to FIG. 3. According to an application of a printing article, if necessary, other gradational patterns may be further printed over those gradational patterns by changing the color or tone of the ink. As a result, the original picture with the gradational patterns I, as shown in FIG. 7, can be printed.

Next, the printing of the section of the cross-shaped pattern H which has not been cut in the cutting operation described with reference to FIG. 1 is performed as follows. Referring to FIG. 6, printing of the cross-shaped pattern H cannot be found in FIG. 6(*a*) which is an enlarged view of a lower portion of an overcoat of a knight illustrated in FIG. 7. In this case, when the ink permeable holes 9 in the associated section of the color B are to be closed by the resin liquid 10 after printing, a seal film 12 which is cut along boundary lines 6 of coloring of the cross-shaped pattern is adhered on the screen just before the resin liquid is applied to the screen, as shown in FIG. 6(*b*). Then, a pattern seal film section 16 corresponding to the cross-shaped pattern is separated and removed from the screen by an appropriate separation tool so as to form ink permeable holes 9, as shown in FIG. 6(*c*). Printing is conducted by applying a squeezing ink supplier, which has absorbed printing ink or paint, to the surface of the silk screen in this state. After printing, the ink permeable holes 9 are closed by the resin liquid 10 to form a non-permeable film 11, as shown in FIG. 6(*d*), so as to proceed to the next step for printing of a different color or complete the multi-color printing.

According to the present invention, multi-color printing can be conducted by the single screen without using a plurality of screens one after another, and multi-color printing can be managed accurately without printing errors because it is not necessary to replace a screen with another. Besides, even in silk screen printing of the cutting method, gradational patterns can be expressed as in paintings, other patterns can be additionally printed over already printed sections of a color, and erroneous printing can be easily corrected by overlapping a requisite different color. Therefore, it becomes possible to print more complicated and finer matters, and the printing process is widely applicable to various articles.

What is claimed is:

1. A multi-color silk screen printing method comprising the steps of:

cutting a sheet of multi-layer seal film along desired boundary lines for coloring, said multi-layer seal film being laminated such that a film which is to be cut into pattern seal film sections is adhered, by a weak adhesive layer, on a base film for supporting said film at the time of a cutting operation, and such that a separation paper is adhered on a film by a strong adhesive layer;

separating and removing said separation paper from said seal film and adhering said seal film on a silk screen by said strong adhesive layer;

removing, from said seal film, said base film and seal film sections which have been cut into patterns to be printed in a common color, so as to form ink permeable holes, and succeedingly conducting printing;

closing said ink permeable holes used for printing by resin which is not intimate to oil when printing ink is oil ink and by resin which is not intimate to water when printing ink is water ink;

repeating a plurality of times the procedure of removing pattern seal film sections of a different color from said seal film so as to similarly conduct printing by using printing ink of the different color, and closing ink permeable holes after printing; and wherein the steps of closing comprises forming a large number of screen-mesh apertures in accordance with a gradational pattern through a covering film of the resin for closing the ink permeable hole before the resin is solidified, and conducting printing with the section of the gradational pattern of the covering film having said apertures after the covering film of the resin had been solidified.

2. A multi-color silk screen printing method according to claim 1, wherein said apertures are formed through the covering film of the resin when the covering film of the resin is partially removed by contacting a foamed material with the resin films.

3. A multi-color silk screen printing method comprising the steps of:

cutting a sheet of multi-layer seal film along desired boundary lines for coloring, said multi-layer seal film being laminated such that a film which is to be cut into pattern seal film sections is adhered, by a weak adhesive layer, on a base film for supporting said film at the time of a cutting operation, and such that separation paper is adhered on a film by a strong adhesive layer;

separating/removing said separation paper from said seal film and adhering said seal film on a silk screen by said strong adhesive layer;

removing, from said seal film, said base film and seal film sections which have been cut into patterns to be printed in a common color, so as to form ink permeable holes, and succeedingly conducting printing;

closing said ink permeable holes used for printing by resin which is not intimate to oil when printing ink is oil ink and by resin which is not intimate to water when printing ink is water ink;

repeating a plurality of times the procedure of removing pattern seal film sections of a different color from said seal film so as to similarly conduct printing by using printing ink of the different color, and closing ink permeable holes after printing; and wherein the steps of closing comprises adhering a piece of seal film which has been cut along desired boundary lines for coloring to said silk screen prior to closing said ink permeable holes used for printing with resin.

* * * * *